United States Patent [19]

Sharp et al.

[11] Patent Number: 4,995,947

[45] Date of Patent: Feb. 26, 1991

[54] PROCESS FOR FORMING A METAL COMPOUND COATING ON A SUBSTRATE

[75] Inventors: Donald J. Sharp; Milton E. Vernon; Steven A. Wright, all of Albuquerque, N. Mex.

[73] Assignee: The United States of America as represented by the Department of Energy, Washington, D.C.

[21] Appl. No.: 213,012

[22] Filed: Jun. 29, 1988

[51] Int. Cl.[5] ..... C25D 15/00; C22B 60/02

[52] U.S. Cl. ..... 204/1.5

[58] Field of Search ..... 204/181.5, 1.5

[56] References Cited

U.S. PATENT DOCUMENTS

| | | | |
|---|---|---|---|
| 2,856,263 | 10/1958 | Carter et al. | 23/14.5 |
| 3,000,698 | 9/1961 | Crowe | 23/14.5 |
| 3,110,656 | 11/1963 | Mills | 204/193.2 |
| 3,391,281 | 7/1968 | Eerkens | 250/199 |
| 3,394,997 | 7/1968 | De Hollander | 23/346 |
| 3,758,664 | 9/1973 | Gerrald | 423/15 |
| 3,883,402 | 5/1975 | Malone | 204/3 |
| 3,952,263 | 4/1976 | McArthur et al. | 331/94.5 P |
| 3,998,925 | 12/1976 | Fuller | 423/15 |
| 4,039,703 | 8/1977 | Kamijo et al. | 55/158 |
| 4,126,420 | 11/1978 | Fuller | 422/162 |
| 4,160,956 | 7/1979 | Fader | 331/94.5 P |
| 4,222,828 | 9/1980 | Zuurdeeg | 204/16 |
| 4,255,393 | 3/1981 | Chiang | 423/15 |
| 4,318,792 | 3/1982 | Snow | 204/181.2 |
| 4,338,125 | 7/1982 | Chang | 75/84 |
| 4,338,215 | 7/1982 | Shaffer et al. | 252/628 |
| 4,528,212 | 7/1985 | Cairns et al. | 427/96 |

OTHER PUBLICATIONS

Webster's Ninth New Collegiate Dictionary, p. 484 (1985).

T. Kerley et al., "Construction of Supported Fission Foils for Laser Excitation", *Rev. Sci. Instruments,* vol. 48, No. 5, May 1977, pp. 557–559.

A. Voinov et al., "Fission-Pumped He-Xe and Ar-Xe Infrared Lasers", Sov. Tech. Phys. Letters, vol. 7, No. 8, Aug. 1981, pp. 437–438.

*Primary Examiner*—John F. Niebling
*Assistant Examiner*—Isabelle R. McAndrews
*Attorney, Agent, or Firm*—Anne D. Daniel; James H. Chafin; William R. Moser

[57] ABSTRACT

A method of coating a substrate with a thin layer of a metal compound by forming a dispersion of an electrophoretically active organic colloid and a precursor of the metal compound in an electrolytic cell in which the substrate is an electrode. Upon application of an electric potential, the electrode is coated with a mixture of the organic colloid and the precursor to the metal compound, and the coated substrate is then heated in the presence of an atmosphere or vacuum to decompose the organic colloid and form a coating of either a combination of metal compound and carbon, or optionally forming a porous metal compound coating by heating to a temperature high enough to chemically react the carbon.

28 Claims, No Drawings

PROCESS FOR FORMING A METAL COMPOUND COATING ON A SUBSTRATE

The Government has rights in this invention pursuant to Contract No. DE-AC04-76DP00789, awarded by the United States Department of Energy.

The present invention relates in general to methods of coating substrates and more particularly to methods of forming a thin adherent coating of a metal compound on a substrate.

BACKGROUND OF THE INVENTION

The technology of coating substrates is well-developed, and methods for forming different combinations of coatings and substrates are described in the prior art. For example, processes for making printed circuits typically include steps of coating a substrate with one or more layers of material. However, new combinations of coatings and substrates typically present new problems which are not solved by methods available in the prior art.

It has been a goal to provide smooth, durable coatings of uranium oxide on various substrates so that the uranium oxide may be used as a source of fission fragments resulting from nuclear reactions. Fragments such as those produced by fissioning U-235 have been found to be useful as a source of energy for exciting laser systems. For example, see U.S. Pat. No. 3,952,263 entitled "Fission Fragment Excited Laser System" issued to MacArthur et al., which describes a system for exciting a laser including a source of neutrons for interacting with fissionable material to form fission fragments.

In order to minimize the absorption of fission fragments within a coating of uranium oxide, it is necessary that the coating be thin, i.e., preferably no more than about 5 microns thick. Adherent coatings of uranium oxide approximately 2½ microns thick have been obtained by repetitive (10–15) brush or spray applications of a uranyl nitrate solution on a substrate, each coating step being followed by pyrolysis at a temperature greater than about 1000° C. In carrying out this process it has been necessary to pyrolize the coating after each application of uranyl nitrate in order to reduce flaking and peeling of the uranium oxide such as would occur if a single thick layer of uranyl nitrate were pyrolized. This process has drawbacks in that the uniformity of coating is dependent upon the skills of the person spraying or painting, and the repititive process results in coating particles being shed throughout the sequence, resulting in radioactive contamination which requires expensive decontamination procedures.

SUMMARY OF THE INVENTION

It is accordingly one object of this invention to provide an improved method of forming a thin metal compound coat on a substrate.

It is another object of this invention to provide a method of forming a thin coat of a fissile material on a substrate.

Other objects of this invention will become apparent from the following detailed description thereof.

In accordance with the invention there is provided a process for forming a layer of a metal compound on a substrate by dispersing submicron-sized particles of a precursor of the metal compound and an electrophoretically active organic colloid within an electrolytic cell in which the substrate is provided as an electrode. An electric potential is then applied between the cathode and the anode of the electrode whereby a layer comprising a mixture of the organic colloid and the particles which are a precursor of the metal compound is deposited on the substrate. The resulting coated substrate is then removed from the electrolytic cell and heated to a temperature high enough to convert the precursor particles to a metal compound. Heating may be in the presence of a vacuum or appropriate gases, and appropriate gases may be oxygen, nitrogen, or inert gases such as argon.

Highly adherent uniform coatings of a metal oxide having coating thicknesses ranging from 0.1 to 4 microns or more have been produced by this process. The coating is sufficiently thin and adherent so that when the process is used to form a metal oxide coating from fissile material as a source of ionizing fission fragments, the self-absorption of the fission fragments in the metal oxide coating is minimized. Experiments have demonstrated that coatings of uranium oxide provide an intense source of ionizing fission fragments when exposed to high neutron fluence bursts of a pulsed reactor and may be used to pump a xenon-fluoride laser.

DETAILED DESCRIPTION OF THE INVENTION

This invention may be used to form coatings of a variety of compounds of different metals on a substrate, the specific conditions for each process obviously depending on the chemistry of the metal. The broad process will be illustrated by describing a process of forming a thin adherent coating of uranium oxide on a substrate; however, the invention should not be considered as being limited to uranium compounds nor metal oxides, and it is especially useful in forming layers of compounds of other fissile materials such as thorium and plutonium in the form of carbides or nitrides.

The metal compound which is the precursor to the coating which is to be formed on the substrate must be substantially insoluble in water and must be sufficiently ionic in character so that it can be electrophoretically deposited.

The metal compound which is preferred as a precursor to a uranium oxide coating is ammonium diuranate having the commonly accepted formula $(NH_4)_2U_2O_7$. There are indications that more atoms of uranium and more than two $NH_4$ groups may be present; however, the formula $(NH_4)_2U_2O_7$ represents quite closely the average composition of this complex uranium compound.

Ammonium diuranate may be made by appropriate treatments of uranium metal, or uranium ores, or a variety of soluble uranium compounds. For example, ammonium diuranate may be made by dissolving $U_3O_8$ in nitric acid to form uranyl nitrate, $UO_2(NO_3)_2$, and then adding ammonia or ammonium hydroxide to the uranyl nitrate, thereby forming ammonium diuranate. A method of forming ammonium diuranate from uranium metal is described in U.S. Pat. No. 2,856,263 to Carter et al., and a method of forming ammonium diuranate from uranium hexafluoride is described in U.S. Pat. No. 3,394,997 to De Hollander.

The particle size of the ammonium diuranate must ideally be less than about one micron. The necessary size may be achieved either by the process of precipitating the ammonium diuranate from an aqueous solution of a soluble uranium salt, or by physically reducing ammonium diuranate particles in size as by ball-milling ammonium diuranate particles which are too big. Methods of producing ammonium diuranate particles having a sub-micron size during the step of precipitating the ammonium diuranate may be found in U.S. Pat. No. 3,998,925 to Fuller and U.S. Pat. No. 4,255,393 to Chang, and the disclosures in these two patents are hereby incorporated by reference.

The substrate must be electrically conductive, and substantially non-reactive under the process conditions for coating. Metals such as nickel and the stainless steels are particularly well-suited as substrates.

The electrophoretically active organic colloid particles attach themselves to the ammonium diuranate particles and move towards the anode under the influence of the electric potential formed within the electrolytic cell. While other organic colloids have this property, it has been found that an aqueous colloid of styrene-acrylate is not only highly effective in transporting the ammomium diuranate particles, but helps bond the ammonium diuranate particles to the substrate.

The process may be carried out over a wide range of ratios of uranium diuranate to the organic colloid and a wide range of total concentration of solids in suspension. In the preferred method of carrying out the invention, the ratio of ammonium diuranate to organic colloid is from 1:10 to 2:10, and the concentration of total solids is preferably in the range of about 40% to about 60% and most preferably in the range of about 45% to about 55% of the total weight of all solids plus liquid. For example, a particularly useful dispersion consists of ten (10) parts of organic colloid, 1.5 parts ammonium diuranate, and ten (10 ) parts deionized water, all parts by weights.

The substrate, which is used as the anode in the electrolyte cell, is coated with a film comprising a finely divided mixture of an organic colloid and ammonium diuranate by applying an electric potential between the anode and the cathode and allowing the voltage to rise until a desired thickness is obtained. A coating thickness of approximately 0.03 microns per volt is typically obtained on a substrate comprising 304 grade stainless steel.

When the substrate has acquired a desired thickness of coating, it is removed from the electrolytic cell, dried in air, and then heat-treated in the presence of oxygen at a temperature at which the organic colloid cross-links to form a rigid coating then slowly pyrolyzes to form carbon. Simultaneously the ammonium diuranate decomposes to form a uranium oxide. The heat-treating temperature may range from about 275° C. to about 350° C. to produce a layer comprising a uranium oxide and carbon.

The carbon does not reduce uranium oxide which is formed to the metal but it will retain uranium in the form of a lower oxide. Lower oxides are preferred since they are more mobile and diffuse more readily into the substrate than higher oxides, and thus bond well to the substrate. The lower oxide of uranium which is formed may be represented by the formula $UO_2$, although the ratio of oxygen to uranium may in fact not be exactly two.

This process may be modified by raising the temperature in the presence of oxygen to a temperature high enough to oxidize and remove the carbon. The removal of carbon results in a slightly porous layer resulting in a reduction in the quantity of the fission fragments absorbed in the $UO_2$ coat when excited by a high neutron flux. Temperatures in the range of 600° C. to 700° C. are preferred since they remove the carbon in a relatively short period of time.

In carrying out the heat-treating and the pyrolysis steps, air may be used as a source of oxygen; however, the reaction can be speeded up by increasing the concentration of oxygen in the atmosphere in contact with the coated substrate.

Having thus described the invention, the following Example is offered to illustrate it in more detail.

EXAMPLE

Sub-micron particles of ammonium diuranate in the amount of 1.5 parts per weight are dispersed in 10 parts by weight of deionized water and 10 parts of DuPont RK 5443 acrylic enamel (a styrenated acrylate). An anode and a cathode are disposed in the resulting suspension, an electric potential is applied to produce a current density of 1 milliamp/cm$^2$ of anode substrate area, and the voltage is allowed to rise until the substrate is coated. The coating is dried in the air for 1 hour then heat-treated in air at a temperature of about 285° C. for approximately 2 hours. The styrenated acrylate cross-links to form a rigid coating, then slowly pyrolyzes to form carbon, and the ammonium diuranate decomposes to form uranium oxide.

The foregoing Example is offered to illustrate the invention and is not intended to limit the scope of the invention. For example, it is obvious that changes may be made in the metal compound to be found on the substrate, in the organic colloid, in the electrode upon which the material is plated, and in the process conditions, including the gas in which the material is heated.

What is claimed is:

1. A method of forming a layer of a metal compound on a substrate, wherein said compound is selected from the group consisting of the compounds of uranium, thorium, and plutonium, said method comprising the steps of:

(a) providing an aqueous dispersion of sub-micron-sized particles of a precursor of said metal compound and an electrophoretically active organic colloid within an electrolytic cell containing at least two electrodes;

(b) providing said substrate as an electrode in said cell, said electrode comprising a cathode and an anode;

(c) imposing an electric potential between said cathode and said anode, whereby a layer comprising a mixture of the precursor particles and said organic colloid is deposited on said anode of said substrate;

(d) removing the resulting coated substrate from said electrolytic cell;

(e) drying said coated substrate in air; and (f) heat-treating said coated substrate at a temperature at which said organic colloid cross-links to form a rigid coating and subsequently pyrolyzes to form carbon.

2. A method in accordance with claim 1 wherein said metal compound is a metal oxide.

3. A method in accordance with claim 2 wherein said metal oxide is selected from the group consisting of the oxides of uranium, thorium, and plutonium.

4. A method in accordance with claim 2 wherein said metal oxide is a uranium oxide.

5. A method in accordance with claim 1, wherein said metal compound is a metal carbide.

6. A method in accordance with claim 1, wherein said metal compound is a metal nitride.

7. A method in accordance with claim 1 wherein the particles of said precursor comprise ammonium diuranate.

8. A method in accordance with claim 1 wherein said electrophoretically active organic colloid is an organic resin.

9. A method in accordance with claim 1 wherein said electrophoretically active organic colloid is a polymer of styrene and an acrylate.

10. A method in accordance with claim 1 wherein said dispersion comprises ammonium diuranate and a polymer of styrene and an acrylate in a ratio of ammonium duranate to polymer of about 1:10 to about 2:10 by weight.

11. A method in accordance with claim 10 wherein said substrate comprises a member selected from the group consisting of nickel and a stainless steel.

12. A method in accordance with claim 10 wherein the coated substrate is heated to a temperature of about 275° C. to about 350° C. to produce a layer comprising carbon and a uranium oxide.

13. A method in accordance with claim 10 wherein the coated substrate is heated to a temperature greater than about 600° C. to produce a porous layer consisting essentially of a uranium oxide.

14. A method in accordance with claim 1, wherein said heat-treating of said coated substrate is performed in a vacuum.

15. A method in accordance with claim 1, wherein said heat-treating of said coated substrate is performed in the presence of an atmosphere.

16. A method in accordance with claim 15 wherein said atmosphere is oxygen.

17. A method in accordance with claim 15 wherein said atmosphere is nitrogen.

18. A method in accordance with claim 15 wherein said atmosphere is an inert gas.

19. A method in accordance with claim 18, wherein said inert gas is argon.

20. An article in accordance with claim 1 wherein the thickness of said layer is from about 0.1 to about 4 microns.

21. A method in accordance with claim 1, further comprising the step of continuing heat-treatment of said coated substrate to a temperature high enough to convert the precursor particles to a metal compound.

22. A method in accordance with claim 21, further comprising the step of continuing heat-treatment of said coated substrate in the presence of oxygen to a temperature high enough to chemically react and subsequently remove said carbon.

23. A method in accordance with claim 21 wherein said heat-treatment of said coated substrate is performed in a vacuum.

24. A method in accordance with claim 21 wherein said heat treatment of said coated substrate is performed in the presence of an atmosphere.

25. A method in accordance with claim 24 wherein said atmosphere is oxygen.

26. A method in accordance with claim 24 wherein said atmosphere is nitrogen.

27. A method in accordance with claim 24 wherein said atmosphere is an inert gas.

28. A method in accordance with claim 27 wherein said inert gas is argon.

* * * * *